US007757445B2

(12) United States Patent
Disterhof et al.

(10) Patent No.: US 7,757,445 B2
(45) Date of Patent: Jul. 20, 2010

(54) PRECAST CONCRETE PANELS FOR BASEMENT WALLS

(75) Inventors: Lee A. Disterhof, Strongsville, OH (US); Steve R. Kemp, Valley City, OH (US); Gary R. Weigel, Valley City, OH (US); Howard J. Mack, Waterford, MI (US); Betsy Mack Nespeca, Lodi, OH (US); Colin J. Gill, Sylvania, OH (US)

(73) Assignee: Mack Industries, Inc., Valley City, OH (US)

( * ) Notice: Subject to any disclaimer, the term of this patent is extended or adjusted under 35 U.S.C. 154(b) by 772 days.

(21) Appl. No.: 11/106,768

(22) Filed: Apr. 15, 2005

(65) Prior Publication Data

US 2005/0252117 A1 Nov. 17, 2005

Related U.S. Application Data

(60) Provisional application No. 60/563,938, filed on Apr. 21, 2004.

(51) Int. Cl.
*E04H 7/20* (2006.01)
*E04G 21/14* (2006.01)

(52) U.S. Cl. ..... 52/223.3; 52/223.7; 52/249; 52/745.1; 52/745.13; 52/745.2

(58) Field of Classification Search ..... 52/745.1, 52/745.13, 223.6, 223.7, 223.13, 223.14, 52/223.2, 223.3, 245, 249, 745.07, 745.08, 52/745.15, 745.2, 745.05, 745.3
See application file for complete search history.

(56) References Cited

U.S. PATENT DOCUMENTS 2,295,216 A 9/1942 Joy
3,300,943 A 1/1967 Owens
3,369,334 A * 2/1968 Berg ..... 52/223.13
3,596,423 A 8/1971 Jacobus
3,608,011 A 9/1971 Jones
3,782,061 A * 1/1974 Minutoli et al. ..... 52/125.5
3,927,163 A * 12/1975 Gabriel et al. ..... 264/71
4,015,383 A * 4/1977 Crowley ..... 52/223.3
4,147,009 A 4/1979 Watry
4,181,286 A 1/1980 Van Doren
4,306,395 A * 12/1981 Carpenter ..... 52/223.6
4,567,705 A * 2/1986 Carlson ..... 52/405.3
4,570,398 A 2/1986 Zimmerman
4,605,529 A 8/1986 Zimmerman
4,612,751 A * 9/1986 Gloppen et al. ..... 52/649.2

(Continued)

FOREIGN PATENT DOCUMENTS

CA 2 489 170 A1 6/2005

*Primary Examiner*—Richard E Chilcot, Jr.
*Assistant Examiner*—Chi Q Nguyen
(74) *Attorney, Agent, or Firm*—Pearne & Gordon LLP

(57) ABSTRACT

A basement wall is provided which includes a precast prestressed hollow core concrete panel. The panel has a plurality of horizontally extending voids and a plurality of horizontally extending tension cables. The panel has a lower portion extending below grade. The panel preferably has a layer of wire mesh positioned between the voids and the inner surface or between the voids and the outer surface. An end cap for the panel is also provided. The panel can have an impressed brick pattern on the above-grade outer surface and the panel can have a window opening, a brick ledge and/or a beam pocket.

37 Claims, 8 Drawing Sheets

U.S. PATENT DOCUMENTS 4,751,803 A 6/1988 Zimmerman
4,781,006 A * 11/1988 Haynes ..... 52/583.1
4,903,446 A * 2/1990 Richards et al. ..... 52/223.6
4,934,121 A 6/1990 Zimmerman
5,055,252 A 10/1991 Zimmerman
5,245,806 A * 9/1993 Baur et al. ..... 52/127.3
5,402,612 A * 4/1995 diGirolamo et al. ..... 52/241
5,440,846 A * 8/1995 Record ..... 52/309.15
5,493,838 A 2/1996 Ross
5,590,497 A * 1/1997 Moore ..... 52/223.3
5,664,378 A * 9/1997 Bettigole et al. ..... 52/414
5,667,192 A 9/1997 Van Doren
5,669,194 A * 9/1997 Colasanto et al. ..... 52/236.8
5,728,312 A 3/1998 Van Doren
5,881,524 A * 3/1999 Ellison, Jr. ..... 52/565
6,385,933 B1 5/2002 Owens
6,434,900 B1 * 8/2002 Masters ..... 52/283
6,581,343 B1 * 6/2003 Metelli ..... 52/223.9
6,698,150 B1 3/2004 DiLorenzo
6,701,683 B2 3/2004 Messenger et al.
7,197,854 B2 * 4/2007 Bettigole et al. ..... 52/414

* cited by examiner

PRECAST CONCRETE PANELS FOR BASEMENT WALLS

This application claims the benefit of U.S. Provisional Patent Application No. 60/563,938 filed Apr. 21, 2004, the contents of which are incorporated herein by reference.

TECHNICAL FIELD

The present invention generally relates to concrete foundation systems. In particular, the present invention relates to precast hollow core concrete panels for basement walls.

BACKGROUND OF THE INVENTION

Concrete panel systems, including the use of precast prestressed hollow core concrete panels, have been used in the prior art primarily to provide pre-manufactured walls for residential or small commercial or industrial buildings. Such systems promise a more accurate building, reduced on-site building time and waste, insect resistance and a hedge against rising lumber prices.

SUMMARY OF THE INVENTION

A basement wall comprising a precast prestressed hollow core concrete panel is provided. The panel has a plurality of horizontally extending voids and a plurality of horizontally extending tension cables. The panel has a top and the panel has a lower portion extending below grade. A wall is provided which extends below grade, the wall comprising a precast prestressed hollow core concrete panel having a plurality of horizontally extending voids and a plurality of horizontally extending tension cables, the panel having a top and having a lower portion extending below grade. A concrete panel is also provided, the panel being a precast prestressed hollow core concrete panel having a plurality of longitudinally extending voids and a plurality of longitudinally extending tension cables.

DETAILED DESCRIPTION OF THE PREFERRED EMBODIMENTS OF THE INVENTION

Figure 1:
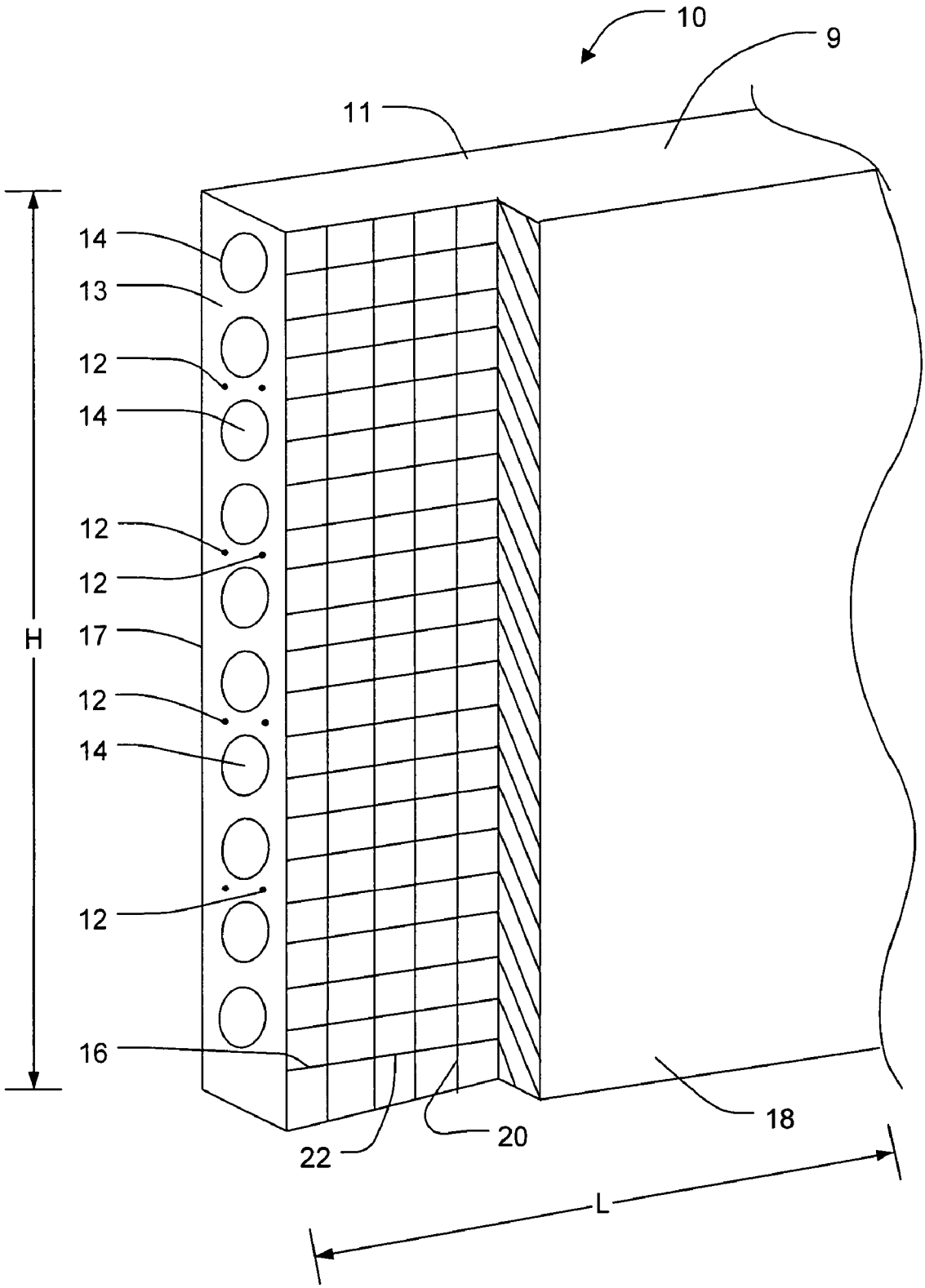
FIG. 1 is a perspective view of a precast concrete panel (not to scale; with the front left portion removed to show wire mesh inside the panel) for a basement in accordance with an aspect of the present invention.

The present invention will now be described with reference to the drawings, wherein like reference numerals are used to refer to like elements throughout. The various drawings are not necessarily drawn to scale from one figure to another nor inside a given figure, and in particular the size of the components may be arbitrarily drawn to facilitate the reading of the drawings. In this description, when a range such as 5-25 or 5 to 25 is given, this means preferably at least 5 and, separately and independently, preferably not more than 25.

Referring to FIG. 1, a precast concrete panel 10 for use in a basement wall is illustrated. The panel 10 is or is essentially a reinforced (with wire mesh) precast hollow core prestressed concrete panel as known in the precast hollow core concrete panel art. The precast concrete panel 10 has an end 13, a top 9, and is a prestressed hollow core panel having a wire mesh material 16 disposed therein. The precast concrete panel 10 comprises concrete or concrete material 11, which is prestressed via a plurality of conventional tension cables 12 disposed longitudinally within the precast concrete panel. As is known in the art, the cables 12 can have a thickness of about ½" to about ⅜" to about ¼"; for example the cables 12 can be ½" dia. 270 KSI LOW-LAX strands. Preferably, eight cables 12 are positioned longitudinally along a length L of the precast concrete panel 10 as shown. In particular, the cables 12 are positioned in pairs as shown and are spaced throughout a height H of the concrete panel 10. The cables 12 are tensioned at about 31,000-32,000 psi during manufacture of the panel and are of a length which corresponds to the length L of the precast concrete panel 10.

The precast hollow core concrete panel 10 also includes a plurality of conventional voids 14 extending longitudinally through the concrete material 11 of the precast concrete panel 10. The panel 10 can include, for example, about ten to fourteen voids that are each about 5" in diameter centered between the inner 18 and outer 17 surfaces of the panel 10 and are spaced at approximately 2" apart. Other conventional hollow core dimensions and arrangements and numbers of voids can be used. The voids 14 are provided to remove weight from the concrete panel 10. For instance, in the present invention, the voids 14 remove approximately half of the weight of the precast concrete panel 10. Any number of voids of any size and shape can be employed to remove weight from the precast concrete panel 10 and is contemplated as falling within the scope of the present invention.

A wire mesh 16 is provided within the concrete 11 of the precast concrete panel 10. In FIG. 1 a portion of the left end of panel 10 has been removed to reveal the welded wire mesh 16 therein. In particular, the wire mesh 16 is provided between an inner surface 18 of the precast concrete panel 10 and the plurality of voids 14. Preferably, the wire mesh 16 is placed about ½ to 1½ inches or about 1 to 1½ inches from the inner surface 18 of the precast concrete panel 10 and about 0-½" from the voids 14. The wire mesh 16 helps to keep the concrete from collapsing into the voids 14 during manufacture of the precast concrete panel 10. The wire mesh 16 additionally provides lateral as well as longitudinal strength to the precast concrete panel 10. The wire mesh 16 includes a plurality of vertically extending wires 20 preferably spaced about 2 inches apart and a plurality of horizontally extending wires 22 preferably spaced about 2 inches apart. The vertically extending wires 20 are preferably of a greater tensile strength and/or stronger gauge than the horizontally extending wires 22. For example, the vertically extending wires 20 can be from 6 gauge to 12 gauge and the horizontally extending wires 22 can be from 10 gauge to 16 gauge. Preferably, the vertically extending wires 20 are 10 or 11 gauge and the horizontally extending wires 22 are 14 gauge; thus the vertically extending wires have greater tensile strength. Alternatively the wires 20 and 22 can be of the same gauge, i.e., 14 gauge, or other gauge.

Figure 2:
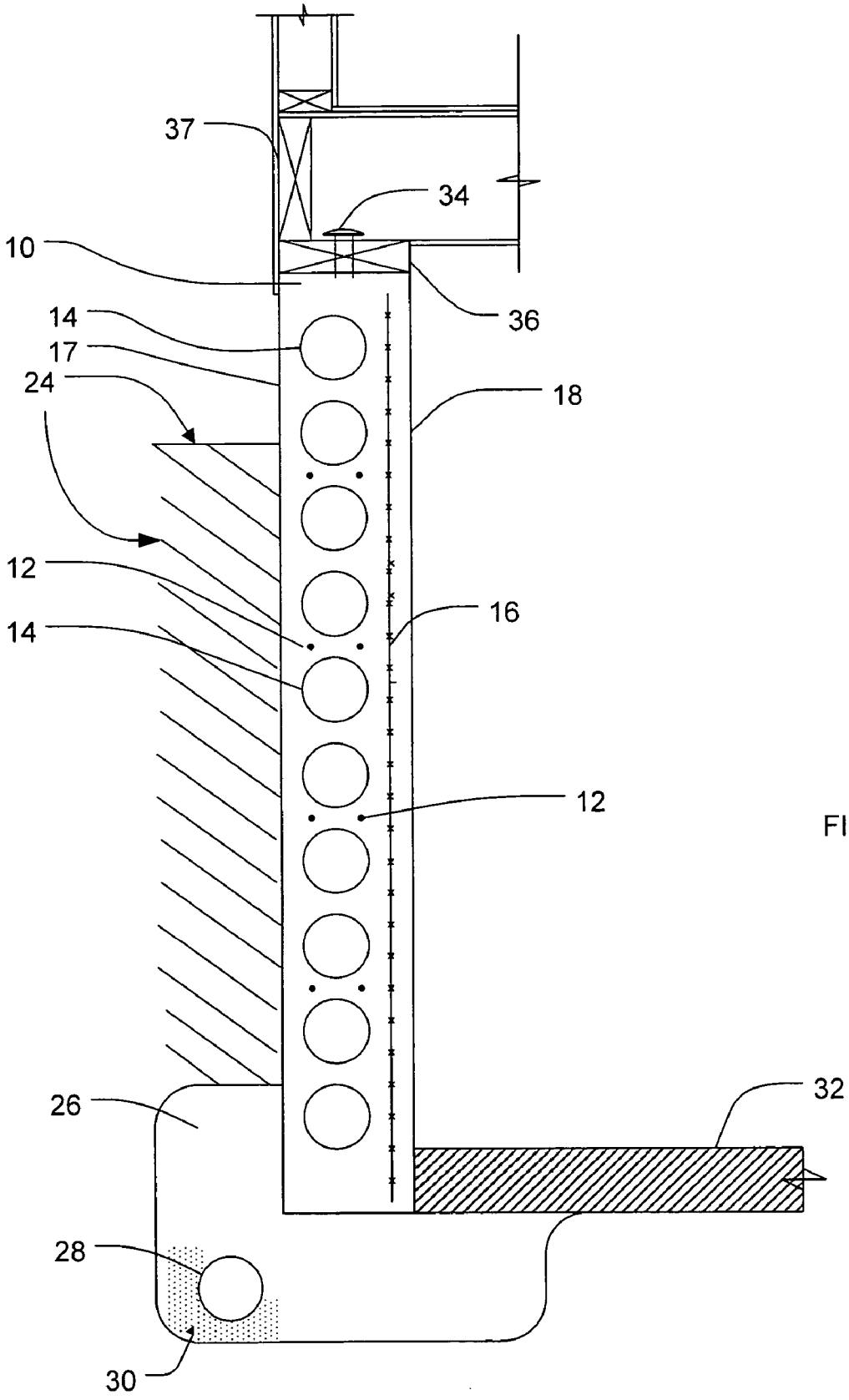
FIG. 2 shows a view partially in cross section of the precast concrete panel installed in a basement.

FIG. 2 show the wire mesh 16 between the voids 14 and the inner surface 18 of the panel 10, that is, on the side away from the outside soil or material 24. Alternatively the panel 10 can be spun around before it is installed so that the wire mesh 16 ends up on the other side of the voids, that is, between the voids 14 and the outer surface of the panel 10, that is, between the voids 14 and the outside soil or material 24 (see FIG. 2). The layer of wire mesh 16 is substantially parallel with surfaces 17 and 18. FIG. 2 shows the panel 10 having an outer surface 17 facing outside soil 24 and an inner surface 18 facing an interior of a basement. Outer surface 17 is facing outside soil 24 even if surface 17 is not in contact with soil 24, such as when backfill or other materials may be between surface 17 and soil 24.

The precast concrete panel 10 is preferably about 8 inches thick, 8'4" high and of a length L and height H which corresponds to a desired length and height of a basement wall or a portion of a basement wall, preferably in residential construction such as a residential house; optionally a basement wall in a commercial or industrial building. Preferably, each precast concrete panel 10 constitutes an entire basement wall. For example, a concrete panel for a basement wall can be about 48' in length and 8' 4" in height (the extra 4 inches beyond the standard 8' is to accommodate a 4 inch concrete basement floor). Further, the precast concrete panel 10 can be provided with one or more window openings, brick ledges, beam pockets, etc. depending upon consumer desires and requirements. See FIG. 11, which shows panel 10 of a basement wall extending above exterior soil 24, the panel 10 having a window opening 8 cut into it. For example, after the panel 10 is cast, a window opening or window well such as window opening 8 can be sawed out and the exposed voids filled with mortar as necessary. Two or more panels 10 can be butted together to provide a single straight basement wall (see panels 10, 10*a* in FIG. 11).

Figure 11:
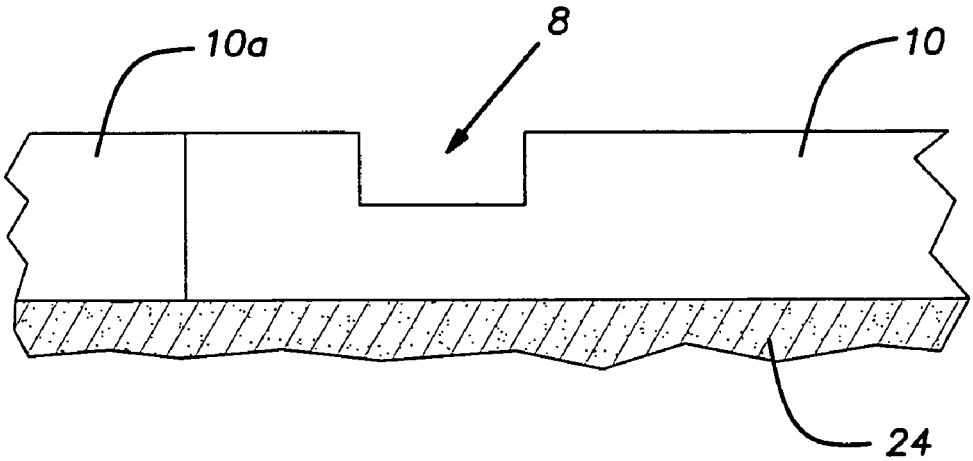
FIG. 11 shows an elevational view of a basement wall with a panel having a window opening, the basement wall extending up out of the soil.
Figure 12:
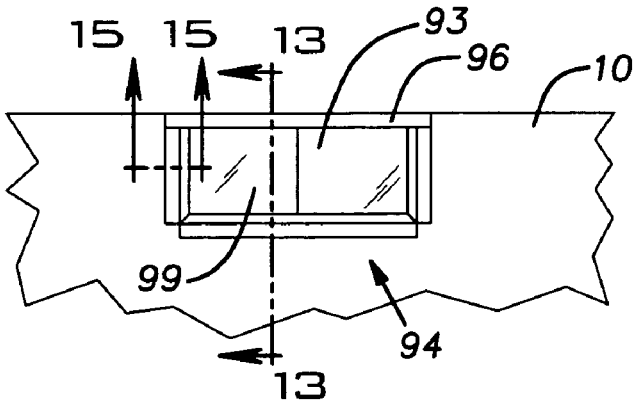
FIG. 12 shows an elevational view of a portion of a precast concrete panel with a window installed in a window opening.
Figure 13:
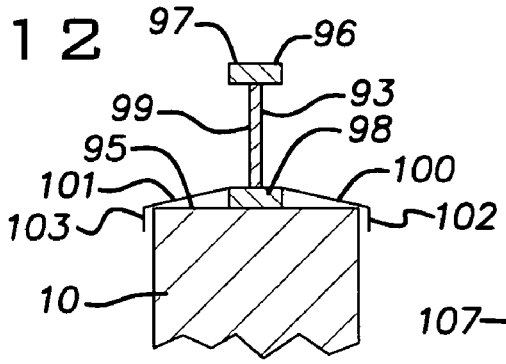
FIG. 13 is a cross sectional view taken along line 13-13 of FIG. 12.
Figure 15:
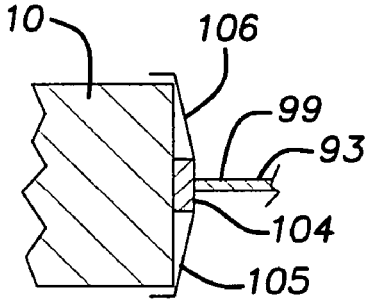
FIG. 15 is a cross sectional view taken along line 15-15 of FIG. 12.

Similar to window opening 8 in FIG. 11, FIG. 12 shows a window 93 installed in a window opening 94 sawed or provided in panel 10. A typical window opening is 32 inches wide and 16 inches high, although other sizes are known. Window opening 94, similar to opening 8, can be cut with a saw, preferably when the concrete is green (partially cured), or it can be cut when fully cured or it can be cut in the field. Optionally opening 94 can be dug out of the panel when the concrete is wet, such as with a trowel, or a mold, such as a four-sided rectangular metal mold, can be inserted into the wet concrete to create the window opening 94. Tension cables 12 may have to be relocated further from the edge of the concrete panel 10 if they are running through where the window opening is supposed to go. FIG. 13 shows surface 95 which was cut with a saw as described above. Window 93 has a pane 99 of glass and a frame 96, preferably plastic, around the perimeter. Frame 96 has a top frame portion 97 and a bottom frame portion 98. The window 93 is also provided with flashing or molding 100, 101, preferably plastic, which preferably is part of, or secured to, frame 96 and which extends from bottom frame 98 outwardly to the edge of panel 10 as shown, where it then bends or curls and a lip or flange or terminal portion 102, 103 extends down about ½ to ¾ to 1 inch over the panel 10. Caulking can be put under portions 102, 103 as a seal. One purpose of the flashing 100, 101 is to provide an aesthetic cover over the rough sawed concrete surface. Also note that each flashing 100, 101 slopes or is tilted downwardly away from bottom frame 98, descending about ⅛-¼-½ inch, descending from the bottom frame 98 to the edge of panel 10 so that water that may collect on the flashing will run off. FIG. 15 corresponds to FIG. 13 and is substantially the same. FIG. 15 shows window 93 with pane 99 of glass and side frame portion 104 and flashing 105, 106 the same as 100, 101, and with the same terminal portions and caulking. To attach window 93, predrilled holes are provided in the side frame portions 104 on each side. After the window 93 and flashings are slid into place, the window 93 is tilted into an open position to expose the side frame portions and screws are inserted through the predrilled holes in the side frames and are screwed into the concrete. Alternatively other attachment means may be used.

Figure 14:
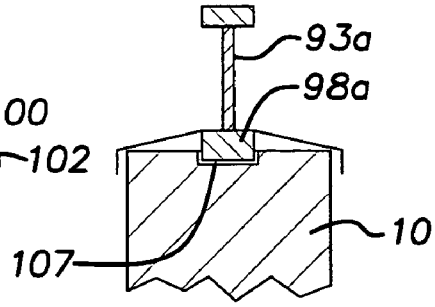
FIG. 14 is substantially the same as FIG. 13 but with a few changes.
Figure 16:
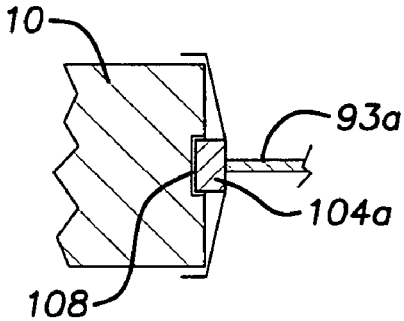
FIG. 16 is substantially the same as FIG. 15 but with a few changes.

FIGS. 14 and 16 show an alternative way to install window 93. FIG. 14 is substantially the same as FIG. 13, except a groove 107, such as 1 inch deep and 2 inches wide, has been provided in panel 10. The bottom frame 98*a* fits into the groove to help secure the window 93*a*. Sloping flashing is also provided as before. FIG. 16 is substantially the same as FIG. 15, except a groove 108, the same as groove 107, is provided in panel 10. On each side of the window 93*a* the side frame 104*a* slides into the groove 108 so that the window 93*a* is securely held in place. With both side grooves 108 holding the window, optionally bottom groove 107 can be omitted. The grooves 107, 108 are provided by providing a metal mold (see description above) having an extension or rib going around 2 or 3 sides and corresponding to grooves 107, 108. The metal mold is inserted into the wet concrete and later slid out to provide the grooves and window opening.

Figure 17:
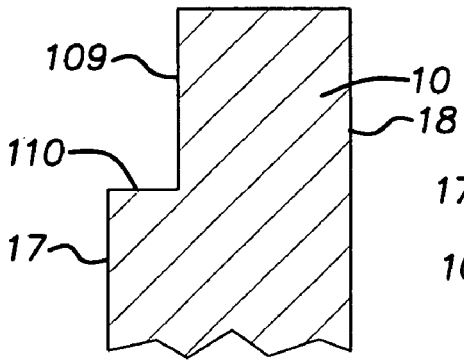
FIG. 17 is a cross sectional view of a top portion of a precast concrete panel.

FIG. 17 shows a cross sectional view of an upper portion of concrete panel 10 having an outer surface 17 facing the soil and an inner surface 18 facing the inside of the basement. Panel 10 has a brick ledge provided therein which is defined by vertical surface 109 and brick support surface 110, both surfaces being cut into panel 10 with a saw (preferably when the concrete is green). Alternatively the brick ledge can be dug out, such as with a trowel, from the top surface of the panel when the concrete is wet, or a block or molding piece can be installed in the slip form or concrete extrusion casting machine so that the brick ledge is formed in the top surface of the panel as the panel is cast in the casting bed. The brick ledge is preferably 4 inches deep and 16 inches high and bricks are installed on the brick ledge after the panel is in the ground. Since the above-grade portion of the panel is usually less than 16 inches, the bricked portion will extend below grade, for an excellent aesthetic appearance.

Figure 18:
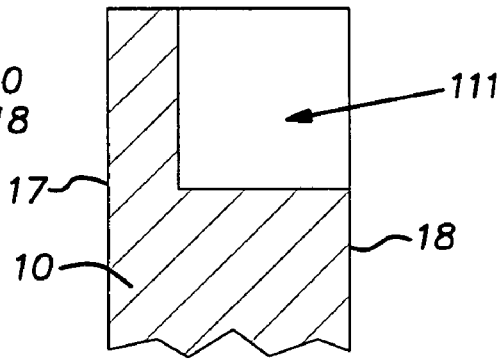
FIG. 18 is a cross sectional view of a top portion of a precast concrete panel.

FIG. 18 is similar to FIG. 17 with a panel 10 having an outer surface 17 and inner surface 18 facing the basement. It has a beam pocket 111, which is known in the art to receive and support an end of a beam in a basement. The beam pocket 111 is preferably about 4-6 inches deep (going from the inside 18 towards the outside 17) and is typically 8-16 inches high and 4-12 inches wide. Beam pocket 111 can be cut with a saw. Alternatively, beam pocket 111 can be dug out while the concrete is wet. It is preferably dug out of or from the bottom of the panel as the panel sits in the casting bed. To achieve this, the pocket is dug out of the panel by digging from the top of the casting bed all the way to the bottom, an appropriately sized styrofoam block is placed on the bottom (i.e. 4-6 inches high) and concrete is then replaced on top of the styrofoam block. The styrofoam block is removed after the panel is cured. The voids 14 and cables 12 and wire mesh 16 are not shown in FIGS. 17 and 18; the cables may have to be moved out of the way before casting and/or the voids may have to be filled or patched with concrete if they are cut into and wire mesh 16 may have to be cut out or sawed through. Also, a steel weld plate substantially as known in the art (for example, 6"×6"×⅜", typically with 2-4 studs welded to the weld plate, each stud being about ½" dia. and 4" long, with a 1" cap or flange or head on the distal end), can be cast into the concrete panel, by casting the weld plate (with studs) into the top or the bottom of the casting bed at a position where the weld plate can be used to attach adjoining panels together via welding the weld plates together as known in the art. To cast the weld plate into the top of the casting bed, the weld plate with studs is embedded in the wet concrete. To cast the weld plate on the bottom of the casting bed, it can be fixed, such as by adhesive or double-sided tape, to the bottom of the casting bed before the concrete is placed in the casting bed. Alternatively, after the concrete is placed, one can dig through the concrete from the top, partially snip and bend back the wire mesh, install the weld plate with studs on the bottom, bend the wire mesh back, and replace the concrete. Subsequently the concrete panels are cut so that the weld plates are properly positioned.

Figure 10:
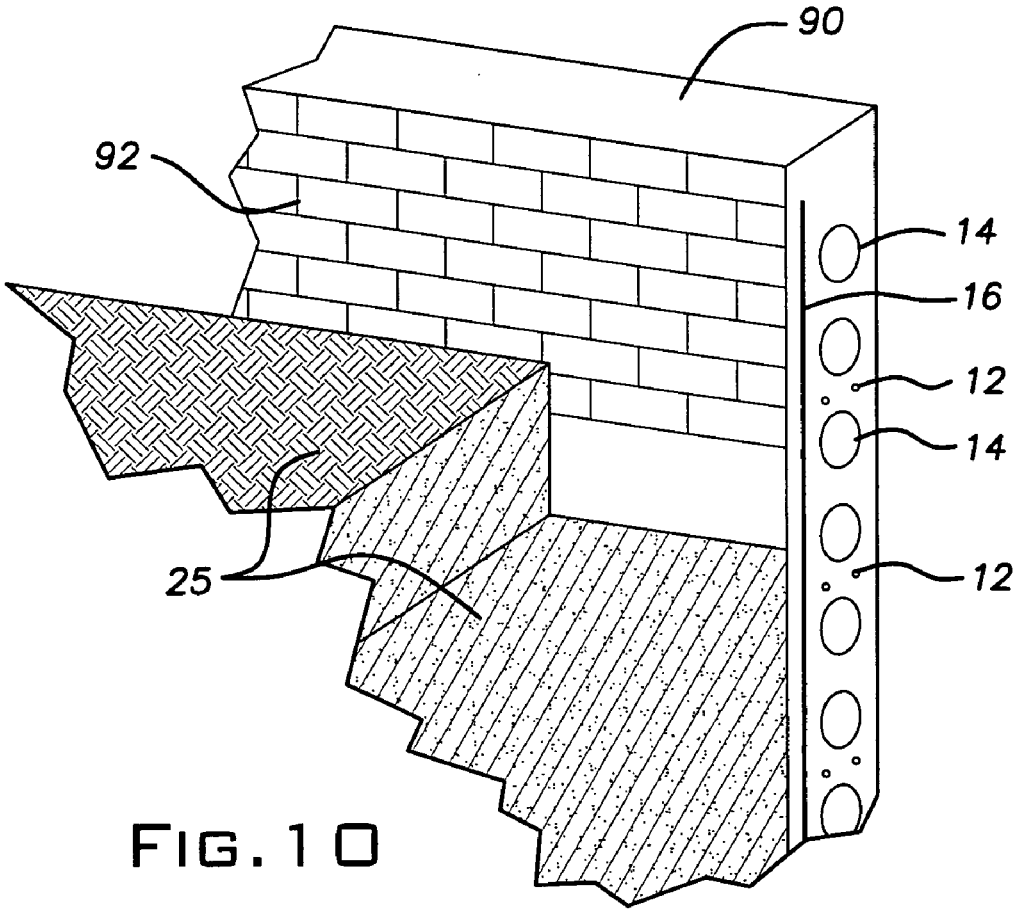
FIG. 10 is a perspective view of a precast concrete panel with an impressed brick pattern installed in a basement with some of the soil cut away.

Regarding FIG. 2, a cross sectional view (with most cross hatchings removed for clarity) of the precast concrete panel 10 is illustrated as installed in a basement. The precast concrete panel 10 is placed within a conventional hole dug out for a basement and is in abutment with a conventional soil sidewall 24. The wall shown in FIG. 2 extends below grade. An upper portion of the precast concrete panel 10 extends above ground a conventional distance (typically 12-16" or 8-24" or 6-28"). As shown in FIG. 2, panel 10 has a lower portion which extends below grade, that is, which extends below the surface of the outside soil or material 24. As shown in FIG. 2, panel 10 has an above-grade portion (the portion which extends above the surface of the outside soil or material 24) and a below-grade portion (the portion which extends below the surface of the outside soil or material 24). As can be seen in FIG. 2, the below-grade portion extends a greater distance than the above-grade portion, that is, if FIG. 2 is considered as drawn to scale, it can be seen that the below-grade portion extends about 82 inches below the surface of the outside soil or material 24, which the above-grade portion extends only about 18 inches above the surface of the outside soil or material 24. A footer 26 is positioned under a bottom portion of the precast concrete panel 10 and is operable to absorb water; thereby preventing water from building up at the bottom portion of the precast concrete panel 10. The footer 26 comprises compacted gravel, crushed stone, and/or the like. If soil conditions do not allow for the proper compaction of a stone or gravel footer, a concrete footer may be utilized. The concrete panel 10 may need to be leveled on the footer through the use of conventional shimming material and/or non-shrink grout placed under the panel 10 to fill any voids between the panel 10 and the footer 26. A size for the footer 26 is determined by a load bearing value of the soil 24. For instance, if a minimum of 2000 psf soil bearing pressure exists, the footer 26 has a minimum thickness of about 10" thick and a minimum width of about 18". The footer 26 also includes a conventional drain 28 to divert water away from the footer 26 and the precast concrete panel 10. A granular backfill 30 can be located around the drain 28 to provide support for the drain 28. FIGS. 1, 2 and 10 all show a portion of a basement wall.

In one embodiment, the precast concrete panel 10 is positioned within the soil 24 such that the reinforcing wire mesh 16 is located inside the voids 14 and not outside the voids 14, that is, as shown in FIG. 2 on the side of the voids 14 which is unsupported by soil 24. Positioning the wire mesh 16 in this manner provides vertical reinforcement over the height H of the precast concrete panel 10. The longitudinally extending voids 14 provided within the concrete material 11 tend to weaken the panel 10 in the lateral direction and soil 24 applies pressure from the outside. Because the wire mesh 16 preferably includes stronger, greater tensile strength vertically extending wires 20 than longitudinally (horizontally) extending wires 22, the wire mesh 16 counteracts the weakness created by the longitudinally extending voids 14 and mitigates inward bowing of the precast concrete panel 10 caused by the load bearing pressure of the soil 24. Alternatively, as shown in FIG. 10, the panel 10 can be installed with the wire mesh 16 on the outside, i.e., between the voids 14 and the soil 24. This preferably results in the smooth top surface (as cast) of the panel 10 being on the outside. This provides an attractive surface on the exterior above-grade portion. In this case it is preferred that the wires 20 and 22 be the same gauge and in this case a smooth steel trowel finish can be provided on the interior side of the panel 10 for better appearance.

Positioned at a bottom of the precast concrete panel 10 in FIG. 2 is a conventional concrete floor 32. Preferably, the concrete floor 32 extends about 4" upwards from the bottom of the precast concrete panel 10. At a top of the precast concrete panel 10 are a plated steel expansion anchor 34 and a wooden sill plate 36. Preferably the wooden sill plate is a 2"×8" wood beam. A conventional wooden floor joist 37 is attached to the wooden sill plate 36 in a conventional manner.

Figure 3:
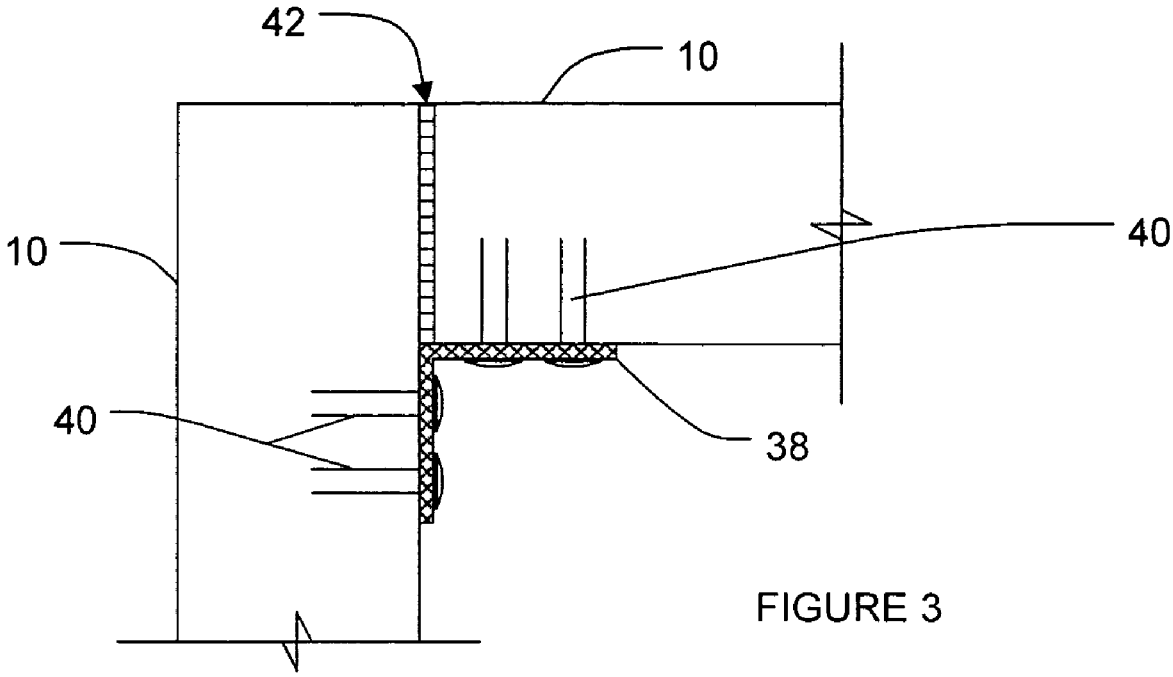
FIG. 3 illustrates a plan view of two precast concrete panels fastened together at a corner.
Figure 4:
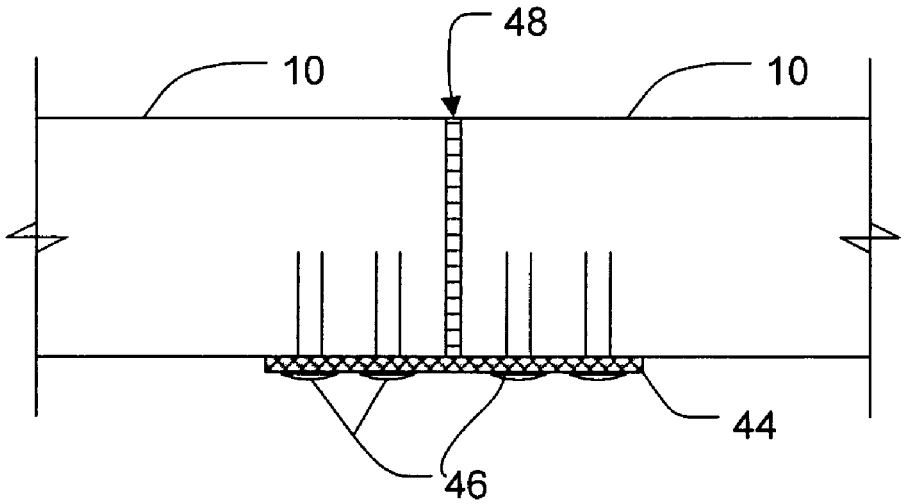
FIG. 4 illustrates a plan view of two precast concrete panels fastened together side by side.

FIGS. 3 and 4 illustrate brackets for securing two precast concrete panels 10 together. In FIG. 3, at least one angle bracket 38 is utilized to secure two panels 10 at a corner of the basement. The angle bracket 38 is preferably metal and can be a 6"×6–×⅜" galvanized steel or type 304 stainless steel angle bracket, which is secured to the precast concrete panels 10 via fasteners 40, such as a ⅝"×3½" plated steel coil anchor. Preferably, two angle brackets 38 are employed to secure two panels 10 together. One angle bracket 38 can be positioned near the top intersection of the two panels 10 and another angle bracket 38 can be positioned near the bottom intersection of the two panels 10. Any space between the panels 10 can be filled by conventional caulk 42 to provide a watertight seal. The angle bracket 38 provided near the bottom intersection of the concrete panels 10 can be positioned about 2" from the bottom end portion of the panels 10. Thus, a 4" concrete floor provided in the basement can substantially cover the bottom angle bracket 38. The top angle bracket 38 is exposed in the basement.

In FIG. 4, at least one straight bracket 44 is employed to secure two concrete panels 10 in an end-to-end abutting manner. The straight bracket 44 is preferably metal and can be a 2"×2"×⅜" galvanized steel or type 304 stainless steel bracket, which is secured to the panels 10 via fasteners 46, such as a ⅝×3½" plated steel coil anchor. Similar to the corner connection described above, two straight brackets 44 can be employed to secure two concrete panels 10 together, one bracket near the top portion of the junction between the two panels 10 and the other bracket near the bottom portion of the junction between the two panels 10. Conventional caulk 48 is utilized to provide a watertight seal between the concrete panels 10.

Figure 5:
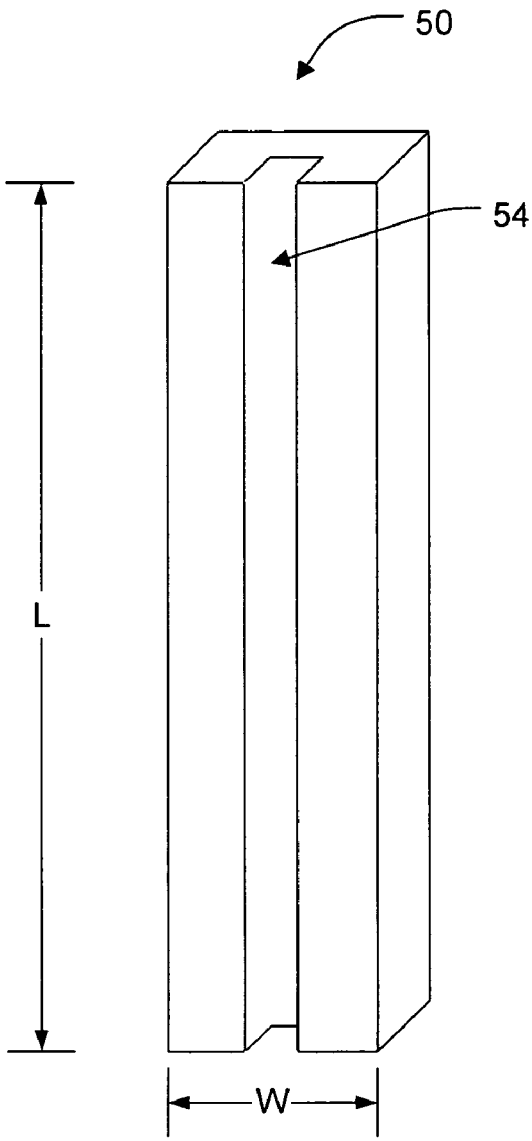
FIG. 5 illustrates a perspective view of an end cap for a precast concrete panel in accordance with an aspect of the present invention.
Figure 6:
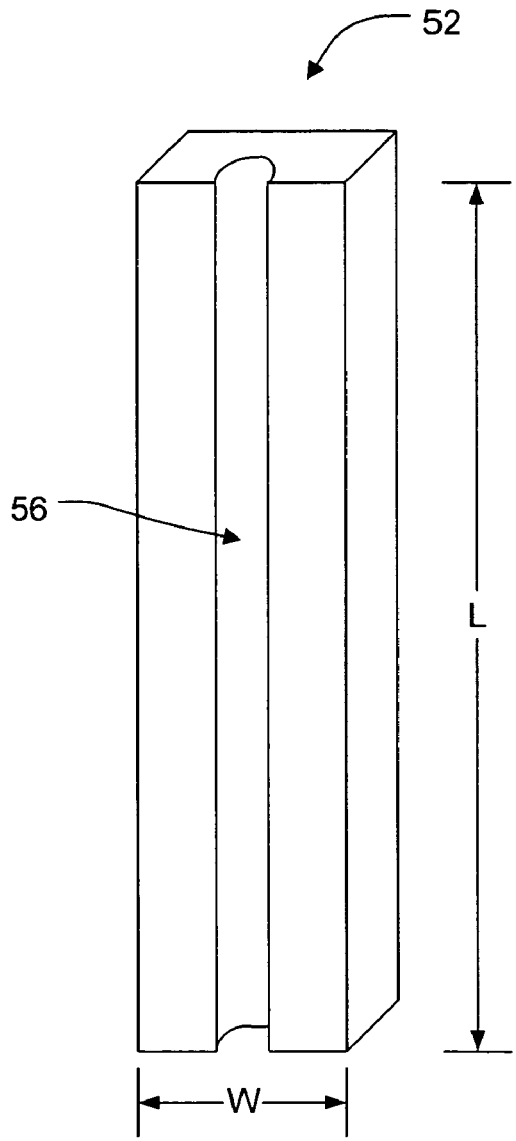
FIG. 6 illustrates a perspective view of another end cap for a precast concrete panel in accordance with an aspect of the present invention.

Turning now to FIGS. 5 and 6, caps for covering an exposed end 13 (FIG. 1) of the precast concrete panel 10 are shown. FIGS. 5 and 6 illustrate caps 50 and 52 having a size and shape that corresponds with an end 13 or end wall of the precast concrete panel 10, the end 13 being an end portion of the concrete panel 10 having apertures which are the beginning of the voids 14. Thus, for a panel 10 having a height of 8' above a basement floor and a thickness of 8", the corresponding caps 50, 52 can have a height H of 8' or 8'4" and a width W of 8". For an 8'4" panel 10 the end caps 50, 52 can be 8'4" long. The caps 50, 52 preferably come to the top of the panel 10. Alternatively, two caps each having a height H of 4' or 4'2" and a width W of 8" can be employed (one stacked on top of the other) to cover the end of the concrete panel 10. Employing two end caps of 4' or 4'2" each facilitates easier handling of the caps by a worker. Further, the caps 50, 52 have a thickness from about ½" to about 6", preferably the caps 50, 52 have a thickness of about 2". Any number of caps of any suitable size and length to cover the end 13 and the longitudinal voids 14 can be employed. The purpose of the caps is to keep dirt, water and animals out of the voids 14 and assist in drainage.

In FIG. 5, the cap 50 includes a rectangular shaped groove or channel 54 that runs longitudinally or lengthwise from top to bottom through a center portion of a sidewall of the cap 50. The rectangular shaped groove 54 is of a width W and depth D sufficient to divert or drain water that may otherwise collect in the voids 14, that is, to permit water that may collect in the void 14 to run out of the void 14 into the channel 54 and down the channel 54 into the footer 26. Preferably, the rectangular shaped groove 54 is about 2" in width W and about ½" in depth D. FIG. 6 illustrates a cap 52 having a semicircular shaped groove 56. A cap having a groove of any suitable size and shape can be employed. Further, the caps 50, 52 are preferably manufactured from concrete; however, any other suitable material can be utilized to manufacture the caps 50, 52.

Figure 7:
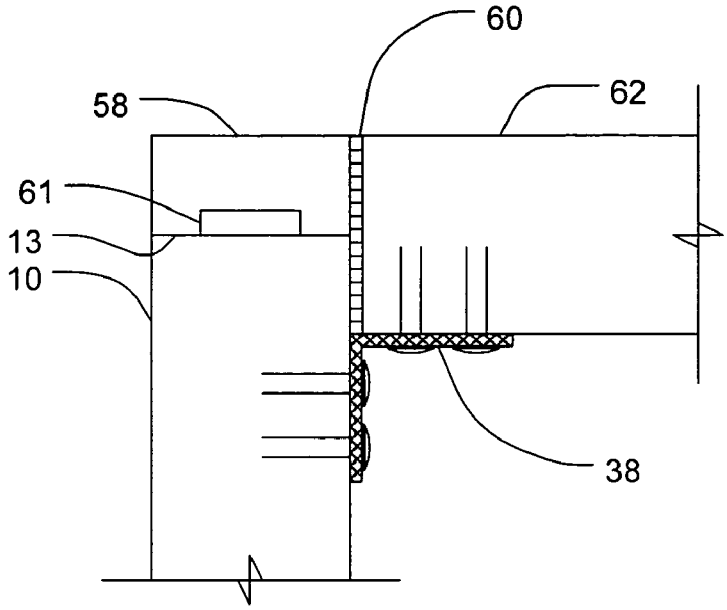
FIG. 7 illustrates a plan view of a precast concrete panel and cap assembly in accordance with an aspect of the present invention

FIG. 7 illustrates a top view of a precast concrete panel and cap assembly in accordance with an aspect of the invention. As shown in FIG. 7, a cap 58 such as caps 50, 52, is positioned in abutment with an exposed end 13 of a first precast concrete panel 10. The cap 58 includes a groove 61 on a sidewall of the cap that is facing the end 13 of the first panel 10; thereby facilitating directing of water out of voids 14 within the first panel 10 and downward toward the footer. A second precast concrete panel 62 (similar or identical to panel 10) does not require a cap since the longitudinal voids 14 in the second panel 62 are sufficiently covered by the first panel 10 and cap 58. Thus, caps are preferably only needed to cover precast concrete panel ends in which the longitudinally extended voids are exposed. Conventional caulk 60 is also shown, along with bracket 38.

Figure 8:
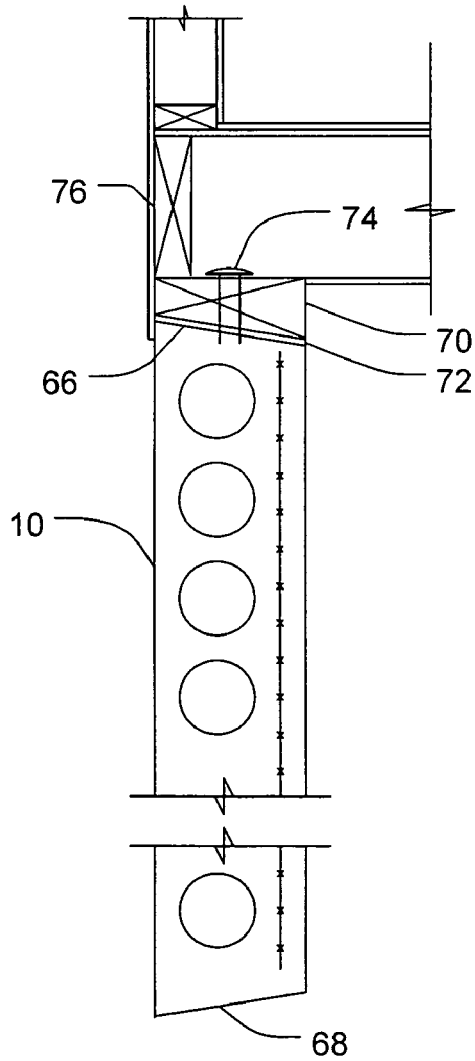
FIG. 8 illustrates a cross section view of a concrete panel and sill plate assembly in accordance with an aspect of the present invention.

FIG. 8 illustrates a cross sectional view (with hatchings removed) of a concrete panel and sill plate assembly. During manufacturing of a precast concrete panel 10, the top surface 66 and bottom surface 68 are tapered to allow for concrete slump; preferably tapered not more than ¼, ½ or ¾ inch. For example, the top and bottom surfaces 66, 68 can each include a ¼ taper inwards. Accordingly, to provide a flat top surface, a sill plate 70 can be tapered to correspond with the taper at the top surfaces 66 of the precast concrete panel 10. A felt pad 72 can be provided between the concrete panel 10 and the sill plate 70 to act as a thermal barrier. The felt pad 72 can be an 8" wide felt pad. Any other suitable thermal barrier material can also be employed. The sill plate 70 is secured to the top surface 66 by lag bolts or any other suitable fastener 74. The fasteners 74 can be placed every three to four feet along the top surface 66. A wooden floor joist 76 is then attached to the wooden sill plate 70 in a conventional manner.

The precast prestressed reinforced hollow-core concrete panel 10 is or is essentially or is largely a conventional product produced in a conventional way with conventional or known machinery as is known in the art. Preferably the panel 10 is produced using a Dynamold slip form or concrete extrusion machine for making hollow core concrete panels, available from Dynamold Corporation, Assaria, Kans. A long casting bed is provided, such as 500' long, 8" high (thick) and 8'4" wide. A plurality of long tension cables 12 (see cables 12 in FIG. 1) are placed longitudinally the entire length of the casting bed and are placed under about 31,000-32,000 psi tension in accordance with a conventional process. The slip form machine starts at one end of the bed. The machine has slip form sides about 30' long and a series of tubes each about 30' long, each tube to form one void 14. Low slump concrete is poured or placed in the bed under and around the tubes and cables as the slip form machine slowly moves down the bed, enough of the concrete being placed to just about cover the tubes. Then wire mesh 16 is unrolled and placed or stretched over the tubes. More low slump concrete is placed over the wire mesh 16; some of it goes through the wire mesh and joins or mates with the concrete around the tubes. As the tubes are slowly pulled along, the concrete begins to set, the voids are formed and the wire mesh helps keep the concrete from collapsing into the voids. The slip form machine travels down the entire 500 or so feet of the bed. The slip form machine is configured so that each side tapers in about ¼". After the concrete is in place one or more rollers and/or trowelling units smooth the top. Optionally a layer of wire mesh can also be placed underneath the tubes and voids, supported off the bottom of the casting bed by a series of small stand-offs.

Figure 9:
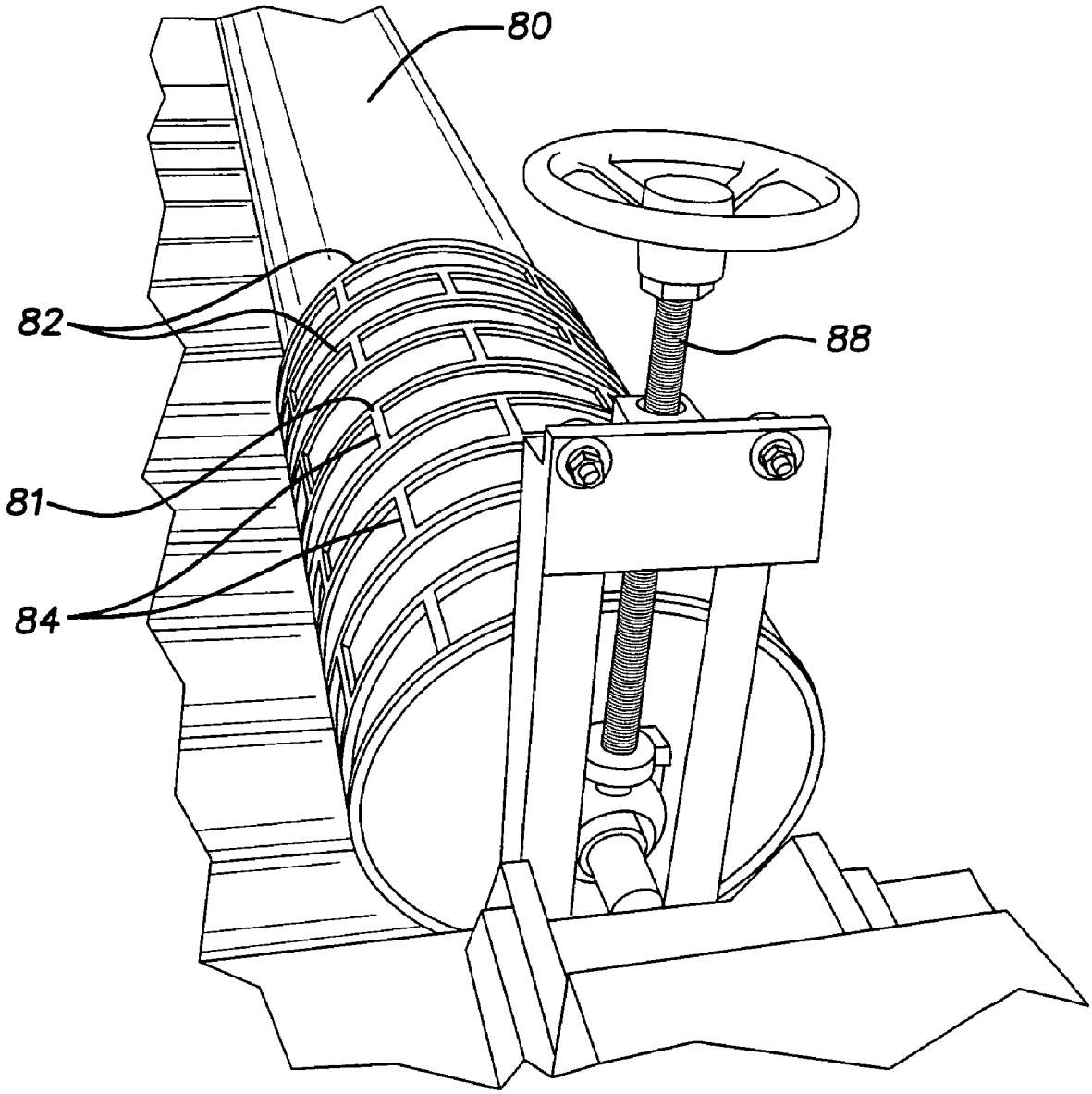
FIG. 9 is a perspective view of a roller for making a brick impression in concrete, the roller having at each end a screw mechanism for raising and lowering the roller (back one not shown).

Optionally, a decorative impressed brick pattern 92 (see FIG. 10) may be imprinted on the surface of the 500' concrete panel during the casting process so as to yield a panel 10 or 90 which can be placed in a basement in such a way that the impressed brick pattern 92 is on the exterior above ground portion. With reference to FIG. 10 there is shown a concrete panel 90 which is the same as panel 10 except as described herein. Panel 90 has voids 14, cables 12 and wire mesh 16. Panel 90 is installed as a basement wall inside soil 25. On the right hand side some of the soil 25 is cut away to reveal the bottom of the brick pattern 92 which extends only partway down panel 90. On the exterior top portion of the panel 90 there is an impressed brick pattern 92, which preferably extends down from the top of panel 90 at least about 12, 15, 16, 18, 20, 22, 24, 36, 48 or 50 inches, at least far enough down the panel 90 so it will extend below grade. Accordingly, impressed brick pattern 92 preferably covers at least the top 12, 15, 16, 18, 20, 22, 24, 36, 48 or 50 inches of the outer surface of panel 90. Optionally the brick pattern 92 can extend the full 8'4" of the panel, such as for a walk out basement. As shown in FIG. 10, a portion of the outer surface of the panel 90 has an impressed brick pattern. The impressed brick pattern 92 can be painted or stained, e.g., red, with a roller, which leaves the joints unstained. Preferably pattern 92 covers not more than the top 24, 30, 36, 42, 48 or 50 inches of the outer surface of panel 90. This impressed brick pattern 92 is provided through the use of a rolling mechanism attached to the slip form or concrete extrusion equipment used to form the 500' panel. With reference to FIG. 9, there is shown a metal or steel roller 80 having attached thereto via welding a brick pattern impressor 81, the brick pattern impressor 81 being made of a series of projecting circumferential or annular ribs 82 and axial ribs 84 made of steel or other material, the ribs 82, 84 being about ⅜-½ inch high and ⅜-½ inch wide and configured and projecting away from the surface of the roller 80 to imprint or impress a brick pattern when impressed into fresh concrete. Depending on the pattern desired, the roller 80 may be 1-4 feet in diameter. The roller 80 preferably extends the entire width of the casting bed although it can extend a shorter distance. The brick pattern impressor 81 may extend the entire length of the roller 80 so as to impress the entire 8'4" width or only be on part of the roller, such as an end portion of the roller as shown in FIG. 9. In typical residential and commercial construction the basement panel or wall extends 12-16 inches above the ground or exterior surface grade. In this case the brick pattern only needs to extend far enough down from the top of the panel 10, 90 to go below grade. To achieve this the brick pattern impressor 81 is provided on enough of the end portion of roller 80 to achieve this result, i.e., at least the terminal 12, 15, 16, 18, 20, 22, 24, 36, 48 or 50 inches of roller 80. In this way only the top portion of the outside of the panel 10, 90 (as the panel 10, 90 is installed in the basement) will be imprinted with the brick pattern. This brick pattern may be required by some aesthetic building codes. It is unnecessary to imprint or impress a decorative brick pattern onto the portion of the panel 10, 90 which will be below grade.

When the panel 10, 90 is cast as described herein, the wire mesh 16 is placed above the tubes forming the voids, and the brick pattern is then imprinted on the concrete above the wire mesh. This results in the wire mesh 16 being between the voids 14 and the brick pattern (see FIG. 10). Accordingly, in order to have the brick pattern appear on the top outsides of the panel 10 or 90 as installed, the panel 10 or 90 is installed as shown in FIG. 10 with the wire mesh 16 on the outside, that is, with wire mesh 16 between the voids 14 and the soil, i.e., the reverse of what is shown in FIG. 2. To form the brick pattern 92, the roller 80 is attached to the slip form machine after the last smoothing roller and as the slip form machine moves along the casting bed to form the 500' concrete panel, the roller 80 is lowered under pressure to transfer the brick pattern on the roller to the surface of the 500' concrete panel. A screw mechanism 88 as shown in FIG. 9 (one at each end of roller 80) may be used to raise and lower the roller 80. The roller 80 should be depressed into and rolled on the concrete while the tubes forming the hollow core voids are still beneath the roller 80, to prevent collapsing the voids. A form release agent is misted onto the roller 80 to prevent sticking of the wet concrete. The roller 80 can be raised and lowered via screw mechanism 88 to impress a pattern only in the desired location. A decorative pattern other than brick may be provided by attaching the requisite impressor elements to the roller 80.

After the casting bed has been provided with the cables, concrete, voids, and wire mesh, and the slip form machine has completed its run over the casting bed, the long concrete panel thus formed is allowed to set for a predetermined time, e.g., one hour. A tarp is then employed to cover the long concrete panel and a heating system provided under the bottom of the 500' bed is set at about 120-180° F. to speed cure of the concrete panel. The heat facilitates hydration of the concrete. The panel is typically left for a predetermined time (e.g., overnight) to sufficiently cure.

Test cylinders of concrete are cured substantially simultaneously with the concrete panel. After the predetermined cure time has expired, tension or strength on the test cylinders is measured. It is determined whether the test cylinders are at a predetermined psi, e.g., about 3000 psi or as known in the art. If the test cylinders are at or above the predetermined psi, the concrete panel is considered finished. Otherwise, the concrete is given more time to sufficiently cure. The tensioned cables are then cut substantially simultaneously at both ends of the 500" concrete panel. When cut, the cables pull the concrete panel into compression. For instance, a 500' panel can shrink in length by about two to about three inches after the cables are cut. Being in compression increases the strength of the subsequently provided concrete panels 10, 90 such that the concrete panel 10, 90 is less likely to crack when handled and employed as a basement wall. The 500' concrete panel is then cut into desired lengths, such as, or at least, 0.5', 1', 2', 4', 6', 8', 10', 12', 16', 20', 24', 26', 32', 40', 48' etc. based upon the size of the to-be-constructed basement walls. Each cut section remains under compression.

After manufacturing and cutting of the concrete panels to the desired dimensions, each panel 10, 90 can be marked (e.g., A, B, C, D) to identify an installation order or an installation location of each panel in a basement, such as a residential or commercial basement. A footer is placed along the perimeter of a hole dug in the ground for the basement. The size of the footer is determined by the soil load bearing pressure. A plurality of prestressed hollow core concrete panels, such as panels 10, 90 are positioned on top of the footer around the perimeter of the basement with the voids 14 oriented horizontally. The panels 10 can be positioned with the wire mesh 16 on (a) the inside or (b) the outside, that is, with the wire mesh (a) between the voids 14 and the interior of the basement or (b) between the voids 14 and the soil 24, 25. If a panel 90 is provided with a brick pattern 92, the panel 90 is installed with the wire mesh 16 on the outside so the brick pattern 92 is on the outside. In the preferred embodiment described above the wire mesh 16 is placed above the tubes and voids in the casting bed. This results in the wire mesh being between the voids 14 and the top surface of the concrete in the casting bed. In the casting bed, when there is no brick pattern impressed, the top surface has a nice, pleasing finished concrete appearance, while the bottom surface is very smooth, almost shiny and doesn't look as good. In this case it may be preferred to place the panel in the hole with the wire mesh on the outside so the good-looking top surface (without a brick or other pattern) is facing outside; this results in the above-grade exterior surface of the panel having a nice finished concrete appearance; the bottom surface, facing inside, can be provided with a smooth steel trowel finish to improve its appearance.

After the panel 10 is placed on the footer, caps are positioned over any exposed ends 13 of the concrete panels 10. The concrete panels, if necessary, are secured together via a plurality of brackets and fasteners. Caulk is employed to provide a watertight seal between the concrete panels. A concrete basement floor is poured. Sill plates are fastened to the top portion of the concrete panels; and floor joists are secured to the sill plates.

Although the concrete panels have been described herein as being employed as basement walls, it is to be appreciated that the concrete panels have a plurality of other uses. For instance, the concrete panels can be utilized as a floor plank for a porch area, to create a basement under a garage, and/or to provide support for a deck.

What has been described above includes exemplary implementations of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A wall which extends below grade, said wall comprising a precast prestressed hollow core concrete panel defining a plurality of horizontally extending voids and having a plurality of horizontally extending tension cables which are located outside of said voids in said concrete panel, said panel having a top, said panel being oriented so that its major surfaces extend in a vertical direction, said panel having a lower portion extending below grade, a first one of said cables being adjacent to a first one of said voids, a second one of said cables being adjacent to a second one of said voids, said panel having a series of reinforcement members located within said panel to provide vertical reinforcement in the vertical direction.

2. The wall of claim 1, said panel having an above-grade portion and a below-grade portion, said below-grade portion extending downwardly a greater distance than said above-grade portion extends upwardly.

3. The wall of claim 2, wherein said panel is at least 12 feet long.

4. The wall of claim 2, said wall further comprising two end caps which together cover an end of said panel.

5. The wall of claim 2, said panel having a tapered top surface and a tapered bottom surface, the taper of each of said surfaces being not more than a half inch.

6. The wall of claim 2, said panel having an end which is about 8 feet 4 inches high.

7. The wall of claim 2, said panel having a window opening.

8. The wall of claim 2, said panel having a brick ledge.

9. The wall of claim 2, said panel having a beam pocket.

10. The wall of claim 2, said wall further comprising a second precast prestressed hollow core concrete panel, said panels being joined by at least one bracket or by embedded weld plates.

11. The wall of claim 2, said panel having an outer surface facing outside soil, wherein at least a portion of said outer surface of said panel has an impressed brick pattern.

12. The wall of claim 2, said panel having a first end and a second end, said first one of said cables extending to but not beyond said first end and extending to but not beyond said second end, said second one of said cables extending to but not beyond said first end and extending to but not beyond said second end.

13. The wall of claim 2, said wall further comprising an end cap covering at least a portion of an end of said panel.

14. The wall of claim 13, wherein said end cap has a longitudinal channel adapted to direct water downwardly.

15. The wall of claim 2, said panel having an outer surface facing outside soil, said panel having an inner surface facing an interior of a basement, wherein said series of reinforcement members is provided by a layer of wire mesh positioned between said inner surface and said outer surface.

16. The wall of claim 15, wherein said layer of wire mesh is positioned between said horizontally extending voids and said inner surface.

17. The wall of claim 15, said layer of wire mesh having a plurality of horizontally extending wires and a plurality of vertically extending wires, said vertically extending wires having greater tensile strength than said horizontally extending wires.

18. The wall of claim 15, wherein said layer of wire mesh is positioned between said horizontally extending voids and said outer surface.

19. The wall of claim 18, wherein at least a portion of said outer surface of said panel has an impressed brick pattern.

20. The wall of claim 19, wherein said impressed brick pattern covers at least the top 12 inches of the outer surface of said panel.

21. The wall of claim 19, said outer surface having an above-grade portion, wherein said impressed brick pattern covers the entirety of said above-grade portion of said outer surface.

22. The wall of claim 20, wherein said impressed brick pattern covers not more than the top 50 inches of the outer surface of said panel.

23. The wall of claim 1, wherein said wall is a basement wall.

24. The wall of claim 23, said panel having an above-grade portion and a below-grade portion, said below-grade portion extending downwardly a greater distance than said above-grade portion extends upwardly.

25. The wall of claim 24, said panel having an outer surface facing outside soil, said panel having an inner surface, wherein said series of reinforcement members is provided by a layer of wire mesh positioned between said inner surface and said outer surface.

26. The wall of claim 25, wherein said layer of wire mesh is positioned between said horizontally extending voids and said outer surface.

27. The wall of claim 24, said panel having an outer surface facing outside soil, wherein at least a portion of said outer surface of said panel has an impressed brick pattern.

28. A concrete panel, said panel being a precast prestressed hollow core concrete panel defining a plurality of longitudinally extending voids and having a plurality of longitudinally extending tension cables which are located outside of said voids in said concrete panel, a first one of said cables being adjacent to a first one of said voids, a second one of said cables being adjacent to a second one of said voids, said panel having a width perpendicular to said longitudinally extending voids, said width being substantially 8 feet 4 inches, said width extending in a Y direction which is perpendicular to said longitudinal direction, said panel having a series of reinforcement members located within said panel to provide transverse reinforcement in the Y direction.

29. The concrete panel of claim 28, wherein the series of reinforcement members is provided by a layer of wire mesh positioned between two major surfaces of said panel.

30. The concrete panel of claim 28, said panel having an outer surface, said outer surface having an impressed brick pattern.

31. A method of constructing a wall which extends below grade, comprising the steps of providing a precast prestressed hollow core concrete panel defining a plurality of voids and having a plurality of tension cables which are located outside of said voids in said concrete panel, a first one of said cables being adjacent to a first one of said voids, a second one of said cables being adjacent to a second one of said voids, and placing said panel (a) so that its major surfaces extend in a vertical direction, (b) so that a lower portion of said panel extends below grade and so that said voids and said tension cables extend in a horizontal direction, said panel having a series of reinforcement members located within said panel to provide vertical reinforcement in the vertical direction.

32. The method of claim 31, wherein said wall is a basement wall.

33. The method of claim 32, wherein said panel as placed has an above-grade portion and a below-grade portion, said below-grade portion extending downwardly a greater distance than said above-grade portion extends upwardly.

34. The method of claim 33, said panel as placed having an outer surface facing outside soil, said panel having an inner surface, wherein said series of reinforcement members is provided by a layer of wire mesh positioned between said inner surface and said outer surface.

35. The method of claim 34, wherein said layer of wire mesh is positioned between said horizontally extending voids and said outer surface.

36. The method of claim 33, said panel as placed having an outer surface facing outside soil, wherein at least a portion of said outer surface of said panel has an impressed brick pattern.

37. The method of claim 32, said panel having a first end and a second end, said first one of said cables extending to but not beyond said first end and extending to but not beyond said second end, said second one of said cables extending to but not beyond said first end and extending to but not beyond said second end.

* * * * *

UNITED STATES PATENT AND TRADEMARK OFFICE

CERTIFICATE OF CORRECTION

PATENT NO. : 7,757,445 B2
APPLICATION NO. : 11/106768
DATED : July 20, 2010
INVENTOR(S) : Lee A. Disterhof It is certified that error appears in the above-identified patent and that said Letters Patent is hereby corrected as shown below:

In column 12, line 64, in claim 31, please delete "extends below grade and so that said voids and said tension" and insert therefor --extends below grade and (c) so that said voids and said tension--.

Signed and Sealed this

Fifth Day of October, 2010

David J. Kappos

David J. Kappos
*Director of the United States Patent and Trademark Office*